US005460699A

United States Patent [19]

Bilan et al.

[11] Patent Number: 5,460,699

[45] Date of Patent: Oct. 24, 1995

[54] VARIABLE INJECTION PROCESS AND APPARATUS FOR ENERGY RECOVERY

[75] Inventors: Stephen W. Bilan, Canonsburg; Anthony J. Nuzzo, Irwin, both of Pa.

[73] Assignee: USX Corporation, Pittsburgh, Pa.

[21] Appl. No.: 251,084

[22] Filed: May 31, 1994

[51] Int. Cl.[6] ..... C10B 51/00; C10B 57/04

[52] U.S. Cl. ..... 201/25; 201/23; 201/40; 201/21; 202/134; 202/251; 202/262

[58] Field of Search ..... 201/21, 23, 25, 201/40; 202/251, 262, 134

[56] References Cited

U.S. PATENT DOCUMENTS

| | | | |
|---|---|---|---|
| 926,702 | 6/1909 | Korting . | |
| 2,049,817 | 3/1933 | McIntosh . | |
| 2,793,176 | 5/1957 | Wassermann et al. . | |
| 3,146,183 | 5/1961 | Reed et al. . | |
| 3,373,085 | 9/1962 | Masciantonio . | |
| 3,647,053 | 3/1972 | Palumbo . | |
| 3,761,360 | 9/1973 | Auvil et al. | 201/40 |
| 4,024,022 | 5/1977 | Fruhbuss . | |
| 4,030,983 | 6/1977 | Beck et al. . | |
| 4,040,961 | 8/1977 | Davis, Jr. et al. . | |
| 4,369,094 | 1/1983 | Flockenhaus et al. . | |
| 4,452,670 | 6/1984 | Kovacic et al. . | |

FOREIGN PATENT DOCUMENTS

| | | | |
|---|---|---|---|
| 47189 | 2/1990 | Japan | 201/23 |
| 1736993 | 5/1992 | U.S.S.R. | 201/21 |

*Primary Examiner*—David L. Lacey
*Assistant Examiner*—Jose A. Fortuna
*Attorney, Agent, or Firm*—Armstrong, Westerman, Hattori, McLeland & Naughton

[57] ABSTRACT

A process and apparatus for recovering energy values of waste tar sludge comprises dewatering the waste tar sludge, transporting the dewatered tar sludge in enclosed containers vented through activated carbon to remove volatile hydrocarbons before vapors are vented to the atmosphere, and injecting the dewatered tar sludge into the side wall of a coke oven charging hole along with a stream of coking coal introduced through the top of the charging hole.

15 Claims, 6 Drawing Sheets

VARIABLE INJECTION PROCESS AND APPARATUS FOR ENERGY RECOVERY

BACKGROUND OF THE INVENTION

1. Field of the Invention

This invention relates to a process and apparatus for recovery of the energy values of waste tar materials by injecting such materials into a coke oven. More particularly, the invention provides a process of injecting into a coke oven waste tar sludge containing volatile hydrocarbons, such as benzene, while minimizing release of such hydrocarbons into the atmosphere.

2. Related Prior Art

It has been known to use waste tar products as additives to a coke oven charge by grinding the waste tar products, adding a diluent, and spraying the diluted tar onto coking coal before charging into the coke ovens. Such prior art processes have the disadvantage of releasing volatiles, such as benzene, contained in the tar, into the open atmosphere, with attendant environmental problems.

Early prior art may have involved adding coal tar pitch, without coal, to a coke oven. Such process did not produce coke.

U.S. Pat. No. 3,146,183 to Reed et al. describes a process of premixing tar sludge and coal for charging into a coke oven. According to this patent, it is unsatisfactory to add tar decanter sludge directly to the coal after or while it is being deposited in the coke oven. If the sludge is added at the top of the bed after the entire charge (of coal) is added to the coke oven, most of the sludge is near the top of the oven and, as the heating of the coal charge is effected during the coking operation, part of the sludge is evaporated and swept out by the hot gases emanating from the coking coal. Furthermore, the sludge is unevenly distributed over the coal and effective coking is not accomphished. According to this patent, addition of the sludge during the charging of the coke oven with coal interferes with the charging operation and the longer time required for such charging operation reduces the production capacity of a coke oven.

SUMMARY OF THE INVENTION

This invention provides a method and means for excavating tar materials containing benzene and other volatiles from a waste pit, straining and dewatering the tar, transporting the tar to an enclosed storage bin, and pumping the dewatered tar from the bin to the top of a coke oven battery, where the tar is injected into the coal charging hole of one or more ovens of the battery, along with a stream of coking coal.

PREFERRED EMBODIMENTS OF THE INVENTION

Figure 1:
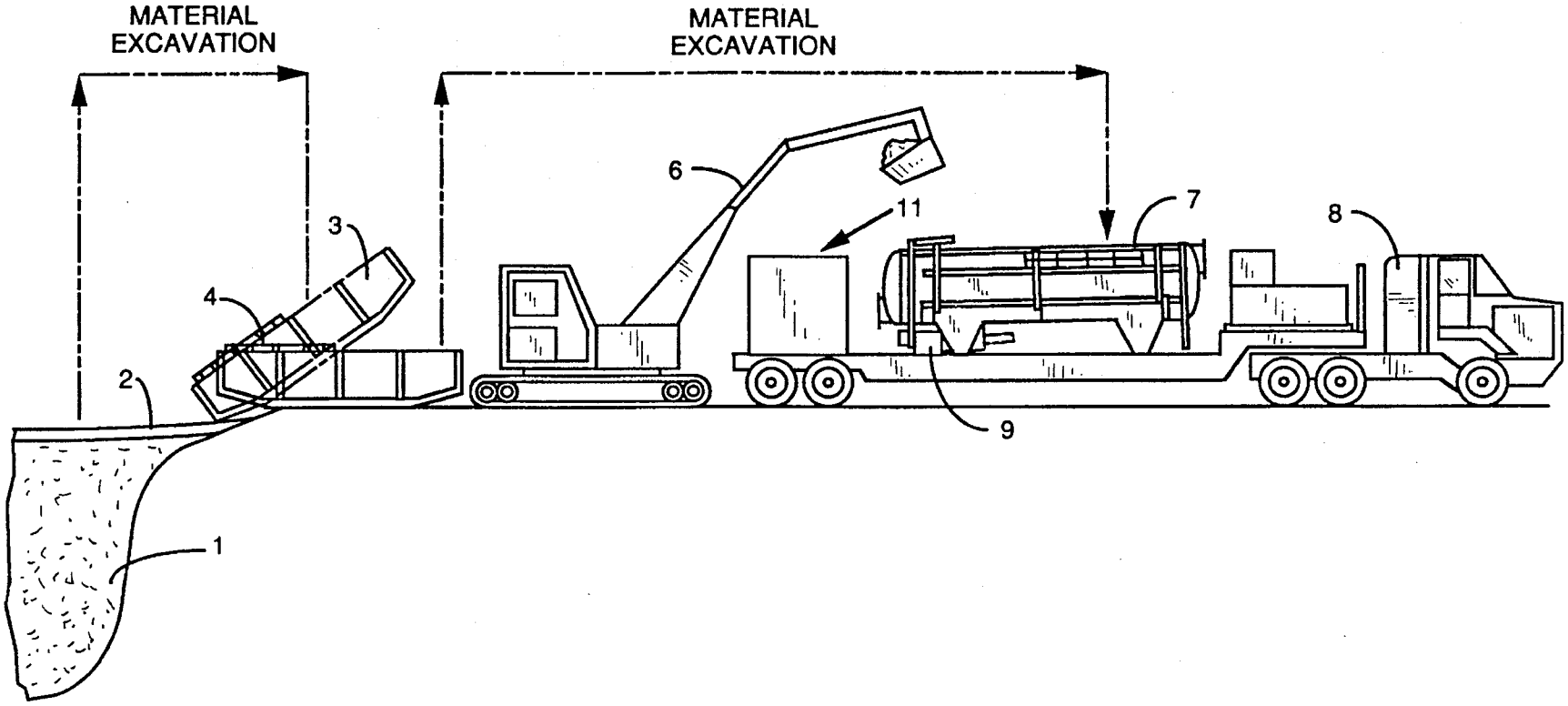
FIG. 1 is a schematic view, in elevation, of means for excavating tar sludge from a waste pit, and loading the excavated tar sludge into a tranport tank truck.

Looking first at FIG. 1, the numeral 1 denotes a waste pit containing tar sludge containing volatile hydrocarbons such as benzene. Typical analysis consists of the following:

| Material | Wt. % |
|---|---|
| benzene | 6.2 |
| toluene | 3.1 |
| PAHS (total) | 3.0 |
| naphthalene | 1.9 |
| xylenes | 1.4 |
| ethyl benzene | 0.6 |
| phenols | 0.3 |
| oil and grease | 4.6 |
| other organic volatiles | 0.3 |
| trace metals | 0.1 |
| non-volatile organics, water, sulfur, other | 78.5 |

Viscosity of the tar sludge may be, for example, in the range of 25,000 to 100,000 centipoises.

Analysis and physical properties of the tar material may vary widely, depending on the source of the tar, which may include the addition of tar decanting sludge and other coke oven by-product wastes.

A layer of water, 2, overlies the waste tar sludge, as shown in FIG. 1. A tiltable dewatering box 3 is provided for deposit of excavated tar sludge and is provided with a screen 4 for removing large foreign objects from the excavated tar sludge. An excavator 6 is provided to deposit tar sludge into box 3 and then into an enclosed transport tank 7 mounted on a truck 8. Tank 7 is provided with a single piston positive displacement pump 9 for pumping the tar sludge out of the transport tank 7. A heating, venting and decanting system, denoted generally by the numeral 11, is mounted on truck 8 for heating the tar sludge in tank 7, dewatering, and venting volatile to atmosphere through an activated carbon filter (see FIG. 2B).

Figure 2A:
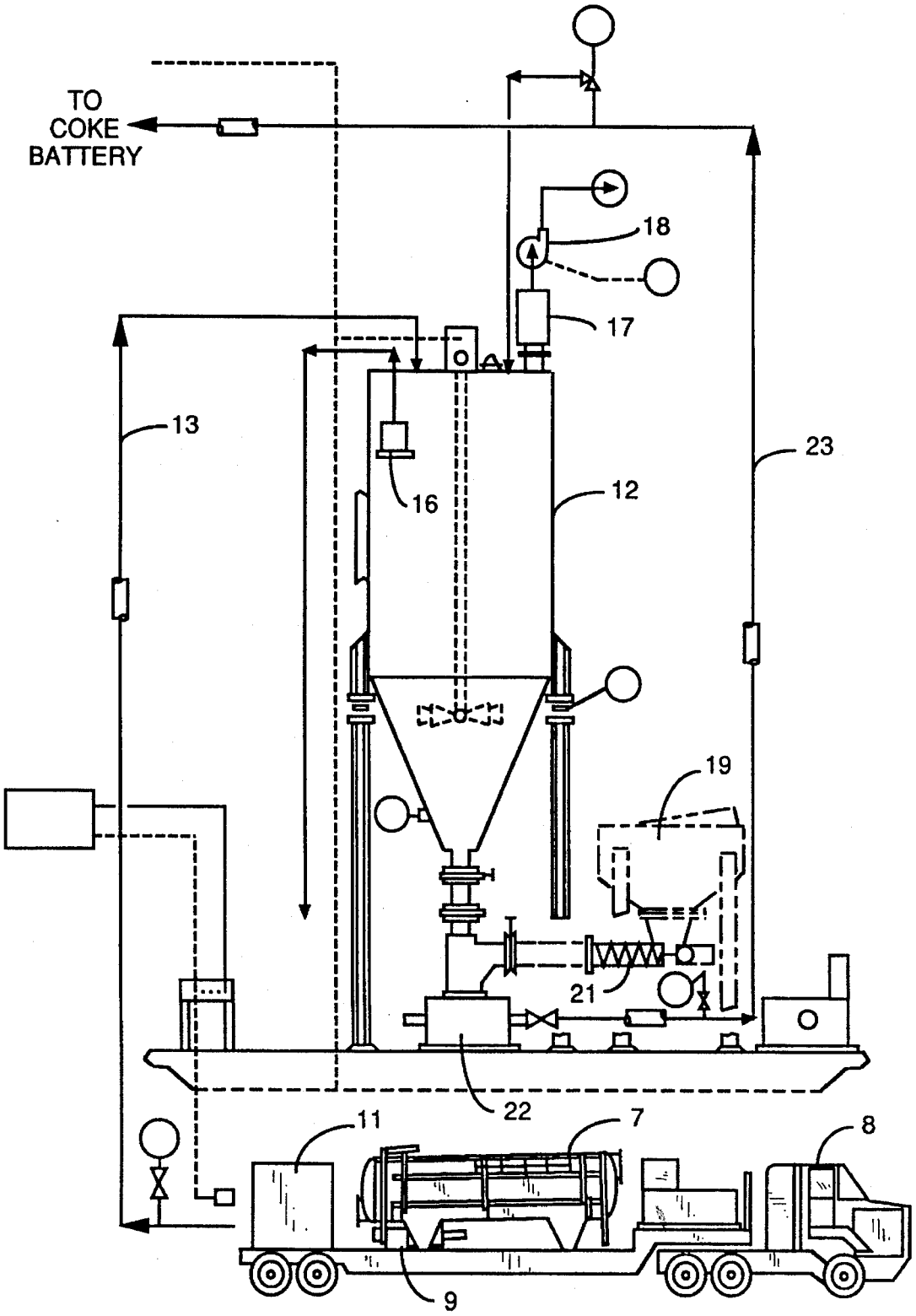
FIG. 2A is a schematic diagram, in elevation, showing the tar sludge transport truck, an enclosed storage bin, and means to pump the tar sludge to the top of a battery of coke ovens.

Turning next to FIG. 2A, truck 8 and associated tank 7 is seen positioned under a storage bin 12. Tar sludge is pumped, by means of pump 9, from tank 7, through the tar sludge heating, venting and dewatering system 11, and through line 13, to the top of bin 12 which is provided with an agitator 14. Water collecting on top of the tar sludge in bin 12 is removed by means of a floating decant pump 16. If desired, a second screen filter (not shown) can be installed at the pump on transport tank 7 to screen out finer particles as the tar sludge is pumped into the bin 12. Also a tank dispersion nozzle (not shown) may be installed at the top of bin 12 to further facilitate water removal.

An activated carbon drum vent 17 is provided, with exhaust fan 18, to vent to atmosphere while removing volatile hydrocarbons in the vented vapor.

An auxiliary materials hopper 19 is provided, with auger 21, to add such auxilary materials, such as coke breeze, coal fines or various tar by-product wastes, as may be desired to add to the stream of tar sludge pumped from bin 12. Tar sludge is pumped from bin 12, by means of a dual piston positive displacement pump 22, through a line 23, to a coke battery.

Figure 2B:
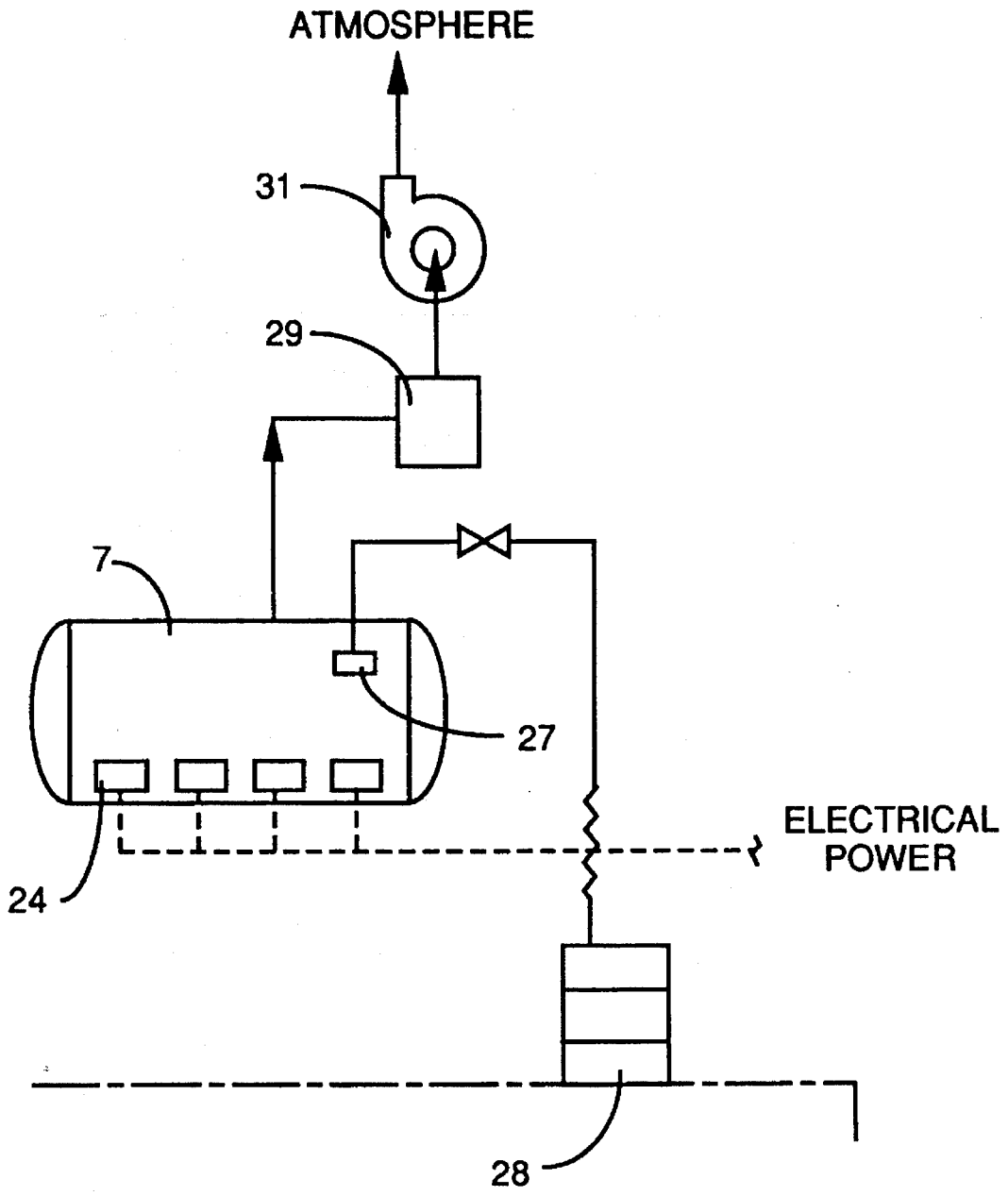
FIG. 2B is a schematic diagram, in elevation, showing details of the transport tank heating, venting and decanting system.

As shown in FIG. 2B, the tar sludge is heated in the enclosed transport tank 7, by means of blanket heaters 24. The tank 7 also is provided with a water decanter means 27 from which decanted water passes to a decant drum 28. Tank 7 also is provided with an activated carbon filter drum 29 from which filtered vapor, essentially free of volatiles, is exhausted by fan 31 to the atmosphere.

Figure 3:
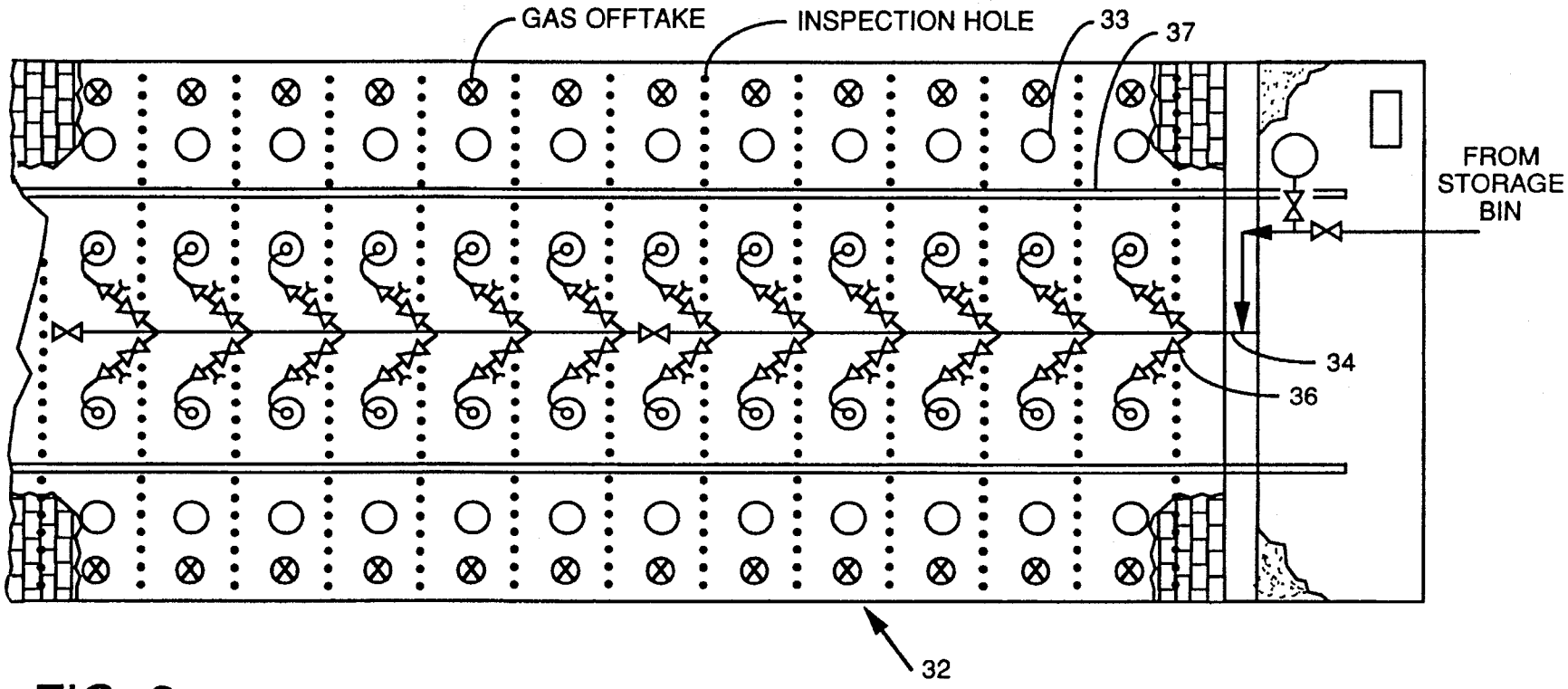
FIG. 3 is a top plan view of a coke oven battery, with means to distribute tar sludge to two charging holes of each coke oven in the battery.

Considering next FIG. 3, there is shown a coke battery denoted generally by the numeral 32 comprising a series of 12 coke ovens, each having four charging holes 33. A tar sludge header 34 extends the length of the battery and branch lines 36 lead to the two charging holes of each oven closest to the header 34. Larry car rails 37 extend the length of the battery and permit a larry car (not shown) to be moved to each charging hole to discharge coking coal therein.

Figure 4B:
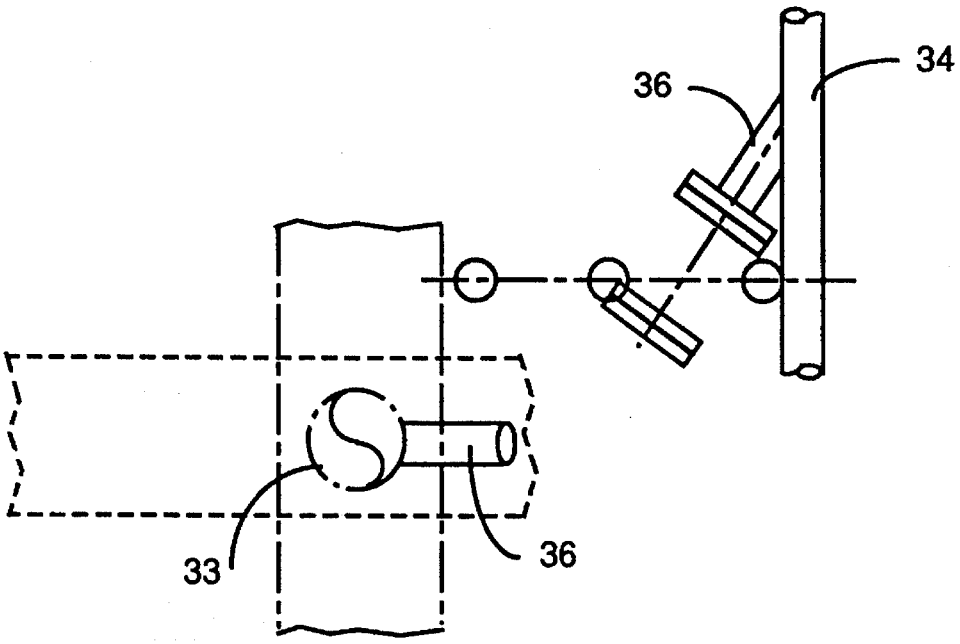
FIG. 4B is a plan view of the apparatus shown in FIG. 4A.
Figure 4A:
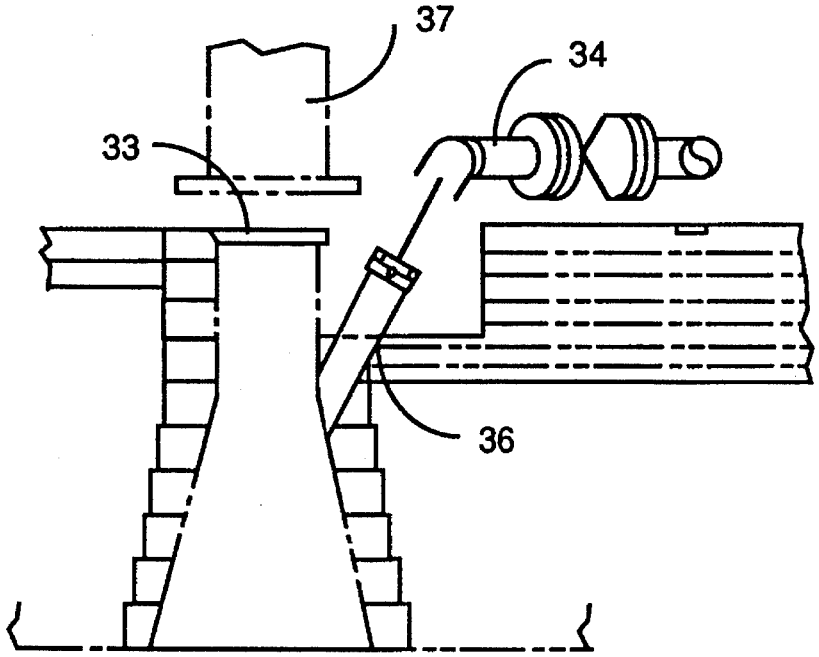
FIG. 4A is an elevational view of means to inject tar sludge into the coal charging hole of a coke oven.

Turning next to FIGS. 4A and 4B, these Figs. show a tar sludge branch line 36, off header 34, entering the side wall of a charging hole 33 at an angle thereto, for example, 45° to 75° from the horizontal. Tar injected through line 36 is mixed with coking coal discharged through larry car chute 37.

Figure 5:
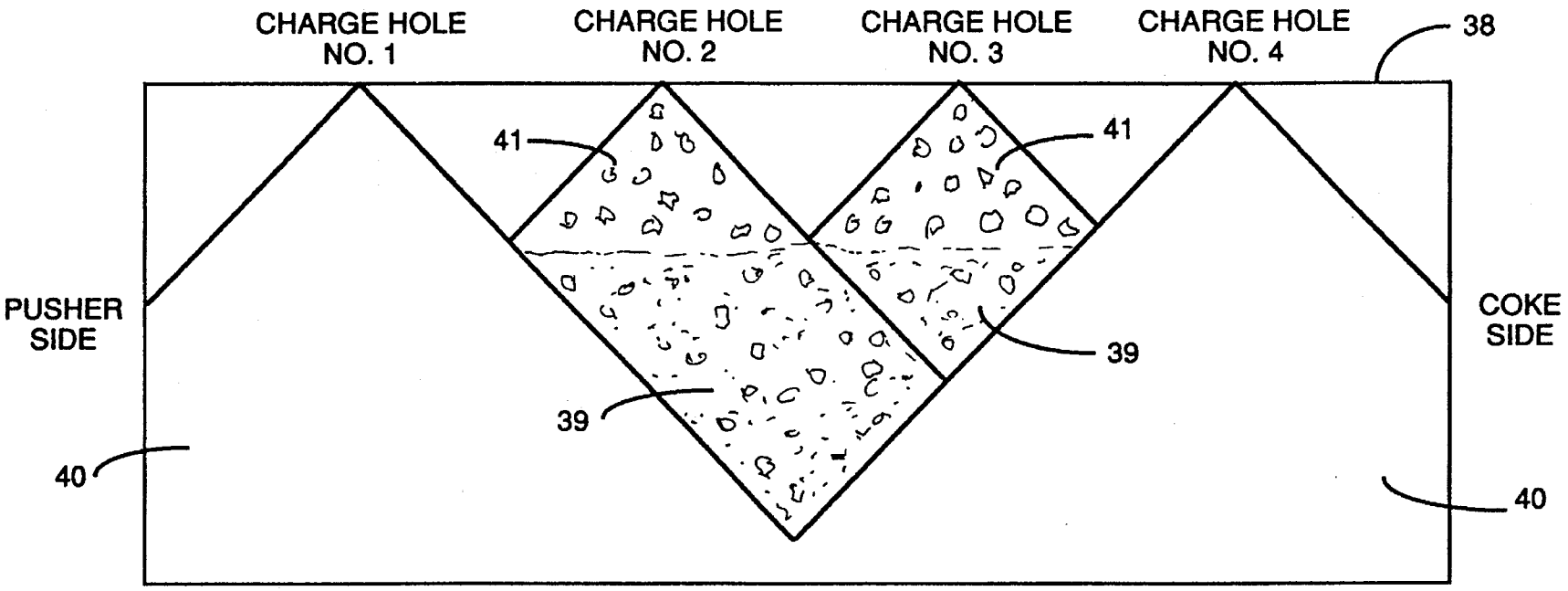
FIG. 5 is an elevational side view of a coke oven showing an exemplary distribution of coal and a mixture of coal and tar sludge across the width of the coke oven.

FIG. 5 shows, in diagrammatic form, a coke oven 38 containing a charge of coal 40, introduced through charging holes 1 and 4, and mixed coal and tar 39, introduced through charging holes 2 and 3. In order to facilitate levelling of the coke oven charge, and to avoid tar sticking to the leveller bar, after the mixture 39 of coal and tar is deposited in the oven, a further charge of coal 41 is made, overlying the coal/tar mixture. Such charging also avoids a too-great demand on furnace flues which would result from an injected mass of tar alone, and minimizes thermal shock of the oven walls.

It is preferred that steam be injected into the header 34 in order to keep the header and branch lines 36 free of tar build-up, to purge these lines of other gases, and to aid in tar flow.

It has been found possible to inject, for example, from one-half to one ton of tar sludge into each oven per oven charge. Tar may be injected into one or a number up to all of the coke ovens in a battery. The injected tar sludge essentially burns to ash and some carbon in the coke oven, with release of substantial heat energy and light oils within the gas stream, thus increasing the overall efficiency of the coking process.

It is important that no water be introduced into the coke ovens, so the tar sludge is dewatered, as above described, at each stage of its handling preparatory to its injection into the coke ovens.

What is claimed is:

1. A method of recovering the energy in waste tar sludge, comprising injecting a stream of tar sludge, along with a stream of coking coal, into a coke oven, and injecting steam into a tar sludge line near the top of the coke oven battery to clean the line of tar, to purge the line of any gas, and to aid in flow of tar.

2. A method of recovering the energy in waste tar sludge, comprising injecting a stream of tar sludge, along with a stream of coking coal, into a side wall of a coal charging hole of a coke oven, and injecting steam into a tar sludge line near the top of the coke oven battery to clean the line of tar, to purge the line of any gas, and to aid in flow of tar.

3. A method of recovering the energy value of tar from a waste pit of tar sludge containing benzene and other volatile hydrocarbons and avoiding releasing volatile materials into the atmosphere, comprising excavating the tar sludge from the pit, straining and dewatering the excavated tar sludge, transporting the strained and dewatered tar sludge in an enclosed transport tank and pumping the strained and dewatered tar sludge from the tank into an enclosed storage bin, pumping the tar sludget from the bin to a header on top of a coke oven battery, injecting the tar sludge from the header, through one or more branch pipes, into one or more charging holes in one or more ovens of the coke battery, and injecting steam into a tar sludge line near the top of the coke oven battery to clean the line of tar, to purge the line of any gas, and to aid in flow of tar.

4. Apparatus for recovering the energy values from waste tar sludge and for minimizing the release into the atmosphere of volatile hydrocarbons contained in the tar sludge, comprising:

a coke oven battery comprising a plurality of serially arranged coke ovens, each oven having a plurality of charging holes arranged in spaced-apart manner along the length of the oven for receiving a stream of coking coal from a larry car movable on rails on top of the battery from one charging hole to another;

means for injecting tar sludge along With the stream of coking coal, said means comprising a tar sludge header line extending along the top of the coke oven battery, and at least one tar sludge injection line extending into at least one of said charging holes of at least one of said coke ovens for injecting a stream of tar sludge into the at least one coke oven in conjunction with a stream of coking coal being charged into the at least one charging hole;

wherein the at least one tar sludge injection line comprises a plurality of branch lines extending, respectively, from the header to a corresponding plurality of said charging holes, and means to inject steam into the tar sludge header line.

5. A method of recovering the energy in waste tar sludge, comprising mixing a stream of coal with a stream of tar sludge to form a mixed stream of coal and tar sludge, injecting the mixed stream into a charging hole of a coke oven, and thereafter charging into the same charging hole a further amount of coking coal to form in the coke oven a layer of coal overlying the previously injected mixture of coal and tar sludge.

6. A method according to claim 5, wherein, after the stream of coal is injected over the mixed stream of coal and tar sludge, the coke oven charge is bevelled by means of a leveller bar.

7. A method of recovering the energy value of tar from a waste pit of tar sludge containing benzene and other volatile hydrocarbons and avoiding releasing volatile materials into the atmosphere, comprising excavating the tar sludge from the pit, straining and dewatering the excavated tar sludge, transporting strained and dewatered tar sludge in an enclosed transport tank and pumping the strained and dewatered tar sludge from the tank into an enclosed storage bin, further dewatering the tar sludge in the storage bin, pumping the tar sludge from the storage bin to a header on top of a coke oven battery, and injecting the tar sludge from the header, through one or more branch pipes, into one or more charging holes in one or more ovens of the coke battery.

8. A method according to claim 7, further comprising heating and further dewatering the tar sludge in the transport tank and venting the transport tank and storage bin to atmosphere through an activated carbon filter to remove volatile hydrocarbons from vented vapor.

9. A method according to claim 7, wherein steam is injected into the tar sludge header.

10. Apparatus for recovering the energy values from waste tar sludge and for minimizing the release into the atmosphere of volatile hydrocarbons contained in the tar sludge, comprising:

an enclosed storage bin for holding the tar sludge;

a coke oven battery comprising a plurality of serially arrranged coke ovens, each oven having a plurality of charging holes arranged in a spaced-apart manner along the length of the oven for receiving a stream of coking coal from a larry car movable on rails on the top of the battery from one charging hole to another;

means for injecting tar sludge along with the stream of coking coal comprising a tar sludge header line and a plurality of tar sludge branch injection lines extending from the header line into a corresponding plurality of said coal charging holes for injecting a stream of tar sludge into each said charging hole in conjunction with a stream of coking coal being charged into the charging hole;

a pump for pumping the tar sludge from the storage bin to the tar sludge header and branch lines into one or more of said charging holes, and means to inject steam into the tar sludge header line.

11. Apparatus according to claim 10, further comprising first dewatering means to dewater the tar sludge contained in the storage bin.

12. Apparatus according to claim 11, further comprising an activated carbon vent means connected to the enclosed storage bin to remove volatile hydrocarbons released from the tar sludge retained in the enclosed storage bin.

13. Apparatus according to claim 12, further comprising enclosed tank means to transport excavated tar sludge from a waste pit to the storage bin, and second dewatering means to dewater tar sludge contained in the tank transport means.

14. Apparatus according to claim 13, further comprising means to screen and remove foreign objects from excavated tar sludge, and third dewatering means initially to remove water from the excavated tar sludge.

15. Apparatus according to claim 13, further comprising means to heat the tar sludge contained in the transport tank and means to remove volatile hydrocarbons from vapor vented from tile tank to the atmosphere.

* * * * *

UNITED STATES PATENT AND TRADEMARK OFFICE

CERTIFICATE OF CORRECTION

PATENT NO. : 5,460,699
DATED : Oct. 24, 1995
INVENTOR(S) : Stephen W. Bilan and Anthony P. Nuzzo It is certified that error appears in the above-indentified patent and that said Letters Patent is hereby corrected as shown below:

On title page, item [75]

Inventor "Anthony J. Nuzzo" should read

--Anthony P. Nuzzo--.

Signed and Sealed this

Twenty-seventh Day of February, 1996

*Attest:*

Bruce Lehman

BRUCE LEHMAN

*Attesting Officer*

*Commissioner of Patents and Trademarks*